US005201679A

United States Patent [19]

Velte, Jr. et al.

[11] Patent Number: 5,201,679

[45] Date of Patent: Apr. 13, 1993

[54] MARINE PROPELLER WITH BREAKAWAY HUB

[75] Inventors: Carl J. Velte, Jr.; James L. Kusiak, both of Grand Rapids, Mich.

[73] Assignee: Attwood Corporation, Lowell, Mich.

[21] Appl. No.: 806,653

[22] Filed: Dec. 13, 1991

[51] Int. Cl.[5] ..... B63H 1/20

[52] U.S. Cl. ..... 440/49; 440/83; 416/134 R

[58] Field of Search ..... 440/49, 83; 416/134 R, 416/93 A, 169 R; 464/87, 88, 89, 92, 93

[56] References Cited

U.S. PATENT DOCUMENTS

| | | | |
|---|---|---|---|
| 390,615 | 10/1888 | Nye . | |
| 2,070,329 | 2/1937 | Brecht | 64/27 |
| 2,363,469 | 11/1944 | Goldschmidt | 64/11 |
| 2,539,630 | 1/1951 | Krueger et al. | 64/28 |
| 2,869,774 | 1/1959 | Smith et al. | 230/134 |
| 2,892,329 | 6/1959 | Trigilio | 64/28 |
| 2,993,544 | 7/1961 | Carlson | 170/160.54 |
| 3,045,763 | 7/1962 | Perrott | 170/160.54 |
| 3,064,454 | 11/1962 | Sharples | 64/28 |
| 3,096,106 | 7/1963 | Wanner | 464/89 X |
| 3,136,370 | 6/1964 | Carlson | 170/173 |
| 3,246,698 | 4/1966 | Kiekhaefer | 170/166 |
| 3,256,939 | 6/1966 | Novak | 170/160.53 |
| 3,307,634 | 3/1967 | Bihlmire | 170/160.54 |
| 3,318,388 | 5/1967 | Bihlmire | 170/160.5 |
| 3,407,882 | 10/1968 | Wooden et al. | 170/160.54 |
| 3,477,794 | 11/1969 | Abbott et al. | 416/134 |
| 3,563,670 | 2/1971 | Knuth | 416/93 |
| 3,619,882 | 11/1971 | Sobanski et al. | 29/159.2 |
| 3,701,611 | 10/1972 | Lambrecht | 416/134 |
| 3,748,061 | 7/1973 | Henrich | 416/93 |
| 3,764,228 | 10/1973 | Shook | 416/93 |
| 3,865,509 | 2/1975 | Frazzell et al. | 416/93 |
| 3,876,331 | 4/1975 | DenHerder et al. | 416/93 |
| 4,338,064 | 7/1982 | Carmel | 416/134 R |
| 4,414,171 | 11/1983 | Duffy et al. | 264/249 |
| 4,417,852 | 11/1983 | Costabile et al. | 416/2 |
| 4,452,591 | 6/1984 | Fishbaugh et al. | 464/89 |
| 4,457,735 | 7/1984 | Carman et al. | 464/32 |
| 4,477,228 | 10/1984 | Duffy et al. | 416/241 A |
| 4,566,855 | 1/1986 | Costabile et al. | 416/134 R |
| 4,575,310 | 3/1986 | Otani | 416/134 R |
| 4,626,112 | 12/1986 | Kramer | 384/300 |
| 4,826,404 | 5/1989 | Zwicky | 416/134 R |
| 4,842,483 | 6/1989 | Geary | 416/93 A |
| 4,875,829 | 10/1989 | Van der Woude | 416/2 |
| 4,930,987 | 6/1990 | Stahl | 416/93 A |

FOREIGN PATENT DOCUMENTS

| | | |
|---|---|---|
| 2360129 | 2/1978 | France . |
| 558874 | 1/1944 | United Kingdom . |

*Primary Examiner*—Sherman Basinger

*Attorney, Agent, or Firm*—Price, Heneveld, Cooper, DeWitt & Litton

[57] ABSTRACT

A marine propeller with break away hub has an insert cavity with pentagonal cross section extending coaxially with the axis of rotation of the propeller, along at least a portion of the length of the propeller. A resilient insert corresponding to the insert cavity is positioned in the insert cavity. The insert is sized for slip fit with the cavity and is adapted for connection with a propeller drive shaft. Preferably, the insert has a cylindrical aperture with a series of grooves disposed circumferentially thereabout extending coaxially through the insert and the insert is connected with the propeller shaft through a shaft sleeve. The shaft sleeve corresponds to the aperture in the insert, has a cylindrical outer surface with a series of teeth disposed circumferentially thereabout, and has a mounting aperture extending coaxially through the shaft sleeve. The shaft sleeve is sized for hand force slip fit engagement with the insert. The mounting aperture is adapted for mounting the marine propeller on the propeller shaft.

29 Claims, 4 Drawing Sheets

MARINE PROPELLER WITH BREAKAWAY HUB

BACKGROUND OF THE INVENTION

The present invention relates to torque transmission couplings specifically as applied to marine propellers and the transfer of torque from a propeller shaft or an engine drive shaft to the propeller for rotating the propeller to create thrust and propel a vessel.

Many methods are known for accomplishing the task of transferring torque from a propeller shaft to a propeller. Perhaps the simplest is a direct mechanical connection between the shaft and the hub such as by welding, by cross pinning the propeller to the shaft, or by using a splined shaft arrangement for example. However, direct mechanical connection between a propeller and a propeller shaft will result in significant damage to any one of or all of the components of the propulsion system if the rotation of the driven propeller is abruptly interrupted by striking an underwater obstacle or the like. Such an occurrence develops severe torque loading of the propulsion system and can damage one or all of the blades of the propeller; destroy the propeller hub or the connection between the propeller and the propeller shaft; overload and burn propeller shafting bearings; overload and break transmission and reversing gearing used in the propulsion system, including clutch mechanisms for engaging and disengaging the engine from the propeller shaft; and overtorque the engine, resulting in a variety of damage.

An early remedy to minimize the kind and extent of damage resulting from a propeller striking an obstacle relates to cross pinning the propeller to the propeller shaft, but by using a shear pin. The propeller is journaled for slip fit engagement with the propeller shaft and is precluded from such slippage by the insertion of a shearable cross pin which in its simplest form extends through the propeller hub and the propeller shaft. However, this remedy also has its problems insofar as a shear pin may fail to shear at the design torque loading. Even if the pin does properly shear, it then may potentially scour the journaled surface of the propeller hub, causing the propeller to cease to the propeller shaft. Another potential problem with using a shear pin relates to inattentive or inexperienced operators who may not recognize a failure situation after the shear pin has done its job, namely shear, and who will allow the propeller shaft to spin excessively inside the disconnected propeller, again causing the propeller to cease to the propeller shaft. Finally, a shear pin may all too often and easily be replaced with any piece of metal of suitable size, commonly a nail or steel rod for example, which will typically have shear characteristics far exceeding the design shear of the appropriate shear pin. This unwitting substitution results in a mechanical connection between the propeller and propeller shaft of the variety discussed above.

No safety propulsion measure, whereby some degree of residual torque transfer to the propeller remains after the propeller strikes an object, is designed into the propeller mounting systems discussed above. Thus, the vessel is commonly rendered nonoperational and must rely upon other sources for passage to a safe harbor where repairs may be effected.

A common contemporary resolution to the above problems is what might be called a rubber insert or bushing propeller mount. This typically includes a tubular, hard rubber bushing which circumscribes and is vulcanized to a centrally located, metal propeller mounting sleeve. The bushing and sleeve assembly is force fit into a center opening in the propeller hub by application of large forces to the hub and the bushing and sleeve assembly. The propeller mounting sleeve is mechanically connected with the propeller shaft and the rubber insert provides a slip clutch effect between the propeller hub and the propeller mounting sleeve insofar as the propeller shaft and mounting sleeve are allowed to rotate or slip relative to the propeller with severe torque loading of the propeller. Torque transfer to some degree may resume in this propeller mount after the impact or severe torque condition is removed. Thus, this variety of propeller mount provides a degree of damage safety and residual torque transfer subsequent to release.

However, this mount also has various problems. One problem is that the rubber bushing will typically harden with age. Another is that the bushing will also adhere to the inner cylindrical wall of the propeller hub with age. Either of these conditions significantly increases the torque value at which the slip clutch effect will occur. Thus, the damage safety feature of the rubber bushing mount diminishes as the propeller, specifically the rubber bushing, ages.

Another difficulty with the rubber bushing propeller mount is that the amount of torque transferable through the bushing will typically change significantly once slippage occurs. Sometimes the torque transfer capacity of the mount will be greatly diminished, more frequently the torque transfer capacity of the mount will be greatly increased and result in diminished safety for subsequent impacts.

Yet another problem with the rubber bushing propeller mount is found in the repair of this propeller mount. A mechanical press of some sort is required to disassemble the rubber bushing propeller mount and a force as high as sixteen tons is commonly required to press out such rubber bushings from a propeller hub. This amount of force is often unobtainable in many repair shops. Further, this level of force may easily damage and destroy a propeller which is under repair. If the old or damaged rubber bushing is removed from the propeller hub, then a new bushing must be pressed into place in the propeller hub and this procedure again requires a mechanical press capable of large forces, as high as twelve tons.

SUMMARY OF THE INVENTION

The present invention addresses the above enumerated problems with a propeller having a hub with a pentagonal aperture extending coaxially through at least a portion of the hub. A resilient insert corresponding to the pentagonal aperture is provided in the aperture and adapted for connection with a propeller shaft to drive the propeller.

In one aspect of the invention, the pentagonal aperture and the insert are adapted for slip fit engagement in an axial direction with each other so that the insert may be easily inserted into and removed from the aperture. In another aspect of the invention, the insert is connected with the propeller shaft through a shaft sleeve. The insert has a generally cylindrical aperture extending coaxially therethrough with a series of longitudinal grooves spaced circumferentially around the aperture for receiving the sleeve. The sleeve has a corresponding outer surface which is cylindrically shaped with a series of teeth spaced circumferentially about the outer surface for engaging the grooves spaced circumferentially around the aperture in the insert. The shaft sleeve also has a mounting aperture extending coaxially through the sleeve and adapted for sliding engagement in an axial direction with the propeller shaft for easy mounting and removal of the propeller assembly from the shaft.

Thus, a propeller according to the present invention provides a propeller mounting structure which is easily assembled and disassembled. Further, this propeller provides consistent torque loading or slip values before, during, and after severe torque loading situations, such as striking an underwater obstacle for example.

These and other objects, advantages and features of the present invention will become apparent upon review of the following specification in conjunction with the drawings.

DESCRIPTION OF THE PREFERRED EMBODIMENT

Figure 1:
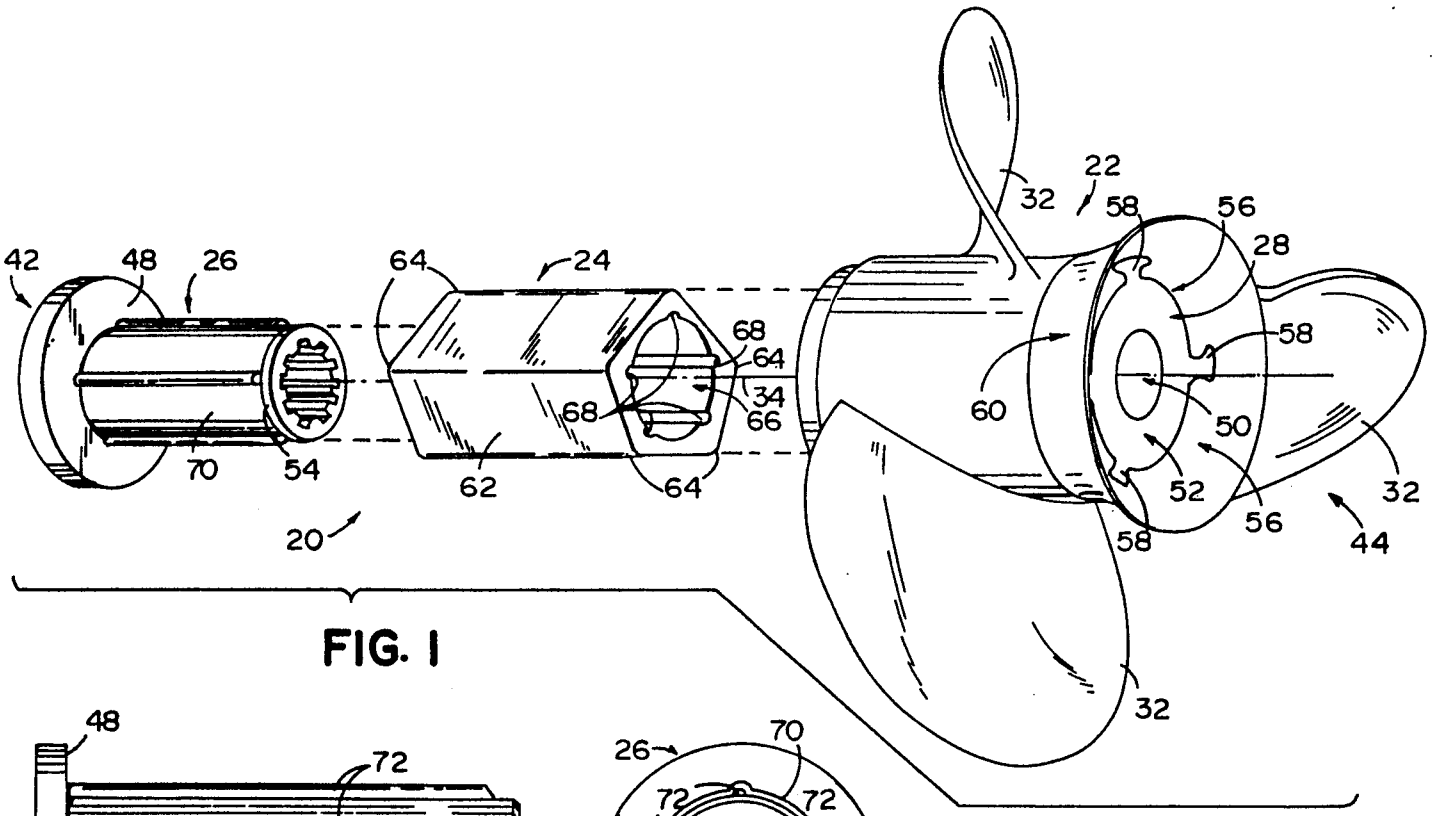
FIG. 1 is an exploded perspective view of a marine propeller according to the present invention.
Figure 6:
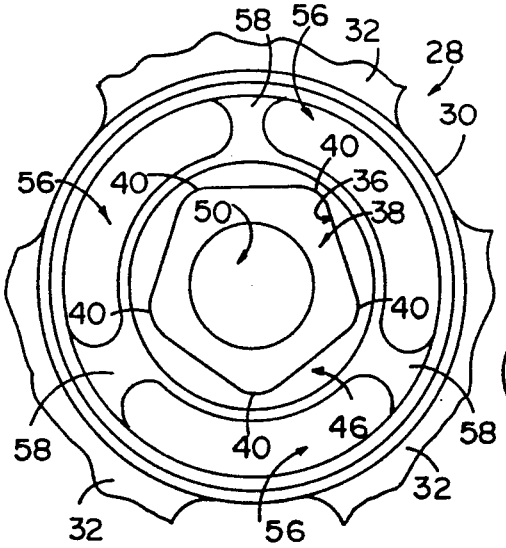
FIG. 6 is a fragmentary, front elevational view of the propeller hub of the propeller of FIG. 1.
Figure 7:
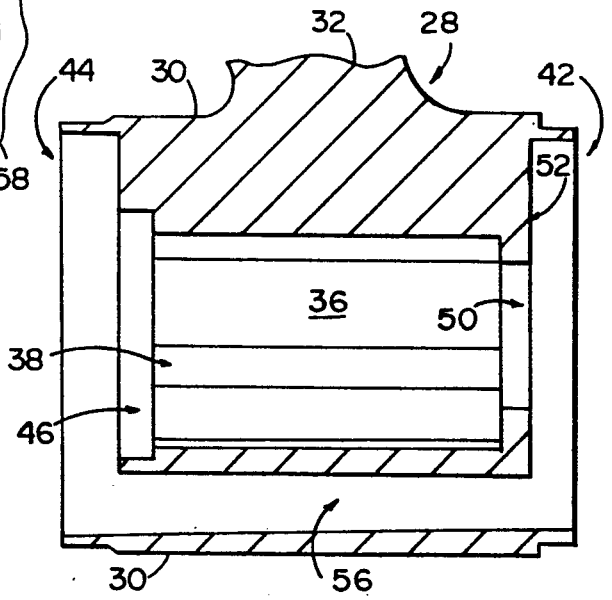
FIG. 7 is a centerline, longitudinal cross-sectional view of the propeller hub of the propeller of FIG. 1.
Figure 8:
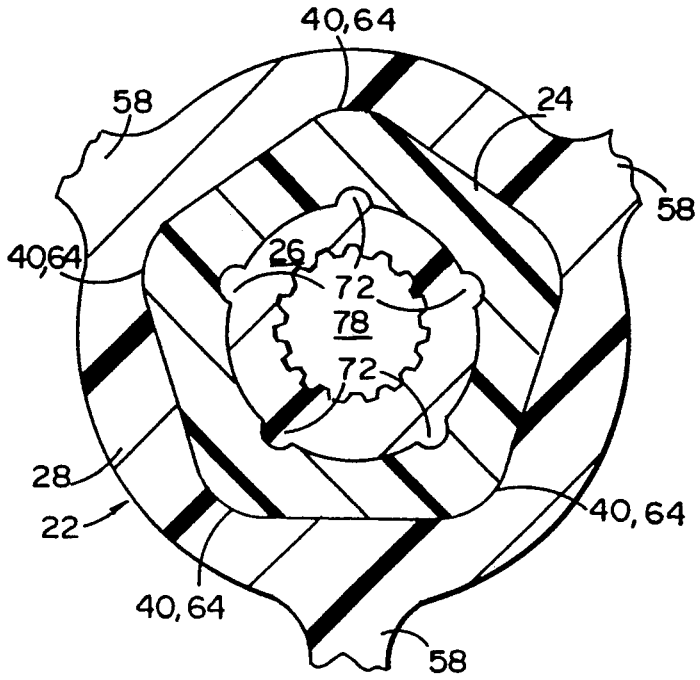
FIG. 8 is a fragmentary cross-sectional view through the assembled propeller of FIG. 1.

Referring to the drawings in greater detail, a screw type marine propeller according to the present invention is generally identified by the number 20 and has a hub assembly 22, an insert 24, and a shaft sleeve 26 (FIG. 1). Hub assembly 22 includes an annular hub portion 28 with a generally cylindrical outer wall 30 (FIGS. 1, 6, and 7). A series of propeller blades 32 extend radially outward from outer wall 30. The number and shape of blades 32 may vary according to the specific propeller application. However, the number of blades 32 will typically be between two and four. Blades 32 will typically have some degree of skew and rake as is known in marine propellers. Blades 32 may also have a "cupped" trailing edge as is known in marine propellers.

While hub assembly 22, including blades 32, may be made of any of the known materials for marine propellers, including, but not limited to, aluminum, bronze, and stainless steel for example, hub assembly 22 is preferably molded in a single piece of a fiber reinforced plastic material such as a 40% glass filled thermoplastic for example. A satisfactory thermoplastic material for this application is available under the trademark ISOPLAST from the Dow Chemical Company.

As with any screw type marine propeller, propeller 20 has a central axis of rotation 34 about which propeller 20 is designed to rotate in use. Annular hub 28 has a length, extending along axis of rotation 34 and an inner wall 36 defining an aperture or cavity 38 which extends coaxially through at least a portion of the hub. Cavity 38 has a generally polygonal cross-sectional shape and preferably a generally pentagonal cross-sectional shape with each vertex 40 of the pentagon being rounded. Cavity 38 is slightly tapered from its widest point near a forward end 42 of propeller 20 to its narrowest point near a rear end 44 of propeller 20. This taper or draft facilitates the insertion into and removal from cavity 38 of insert 24 and the removal of hub assembly 22 from its manufacturing tooling. The preferred draft is about two degrees.

A generally cylindrically shaped recess 46 is provided at the forward end of cavity 38 for receiving a generally cylindrical flange portion 48 of shaft sleeve 26 (FIGS. 1-3 and 6-7). A cylindrical aperture 50 is also provided at the rear end of cavity 38 and penetrates through the rear face 52 of hub assembly 22 from cavity 38 for receiving the rear portion 54 of shaft sleeve 26.

For use in through the hub exhaust installations, a series of exhaust passages 56 are formed through hub 28 for passage of exhaust fluids (FIGS. 1, 6, and 7). A series of spokes 58 are defined between exhaust passages 56. The number of spokes 58 corresponds to the number of exhaust passages 56 and is preferably related to the number of blades 32 so that each blade 32 may be centered over a spoke 58. Thus, there will preferably be three spokes 58 in a three-bladed propeller as shown. As with cavity 38, exhaust passages 56 are also preferably formed with some molding draft.

A generally conically shaped or flared trailing edge portion 60 is shown in FIG. 1 at rear end 44 of hub assembly 22. As with the design and shape of blades 32, the specific design of trailing edge portion 60 is variable and depends upon the requirements of the specific application. Trailing edge portion 60 may alternatively continue cylindrically straight rearward and have an outwardly tapering or conically shaped inner wall for example.

Figure 4:
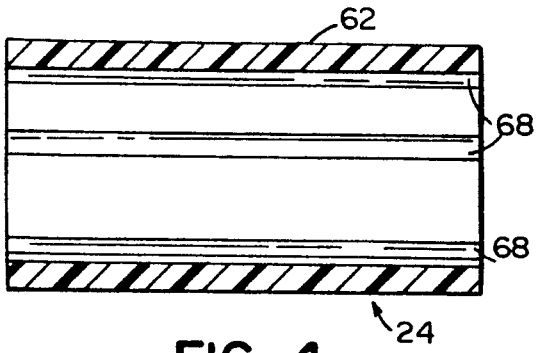
FIG. 4 is a center line, longitudinal cross-sectional view of the insert of the propeller of FIG. 1.
Figure 5:
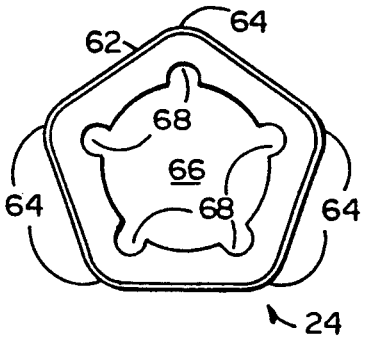
FIG. 5 is a rear elevational view of the insert of FIG. 4.

Insert 24 has a generally pentagonally shaped outer surface 62 corresponding to cavity 38 with rounded vertices 64 and is also preferably a single piece molding (FIGS. 1, 4, and 5). Insert 24 may be molded of any one of various resilient natural or synthetic materials which normally retain their molded shape, permit some flexing and distortion under shear, and resume their molded shape after the stress is removed. However, a preferred material for molding insert 24 is a urethane plastic having a 90-95 durometer specification. Insert 24 corresponds to cavity 38, has the same degree of draft as cavity 38, and is sized for slip fit engagement in an axial direction with cavity 38.

Insert 24 also has a generally cylindrical aperture 66 extending coaxially through insert 24 with a series of preferably five grooves or keyways 68 disposed circumferentially around aperture 66 for receiving shaft sleeve 26. Grooves 68 are also preferably equally spaced about the circumference of aperture 66 and aligned with vertices 64. Aperture 66 is formed with some degree of molding draft for ease of molding and assembly with shaft sleeve 26. The amount of draft molded into aperture 66 is preferably the same as for cavity 28 so that insert 24 has uniform thickness between outer surface 62 and aperture 66.

Figure 2:
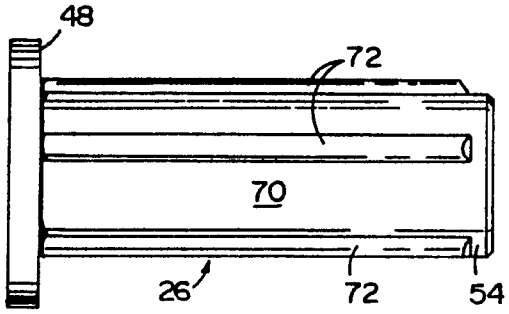
FIG. 2 is a side elevational view of the shaft sleeve of the propeller of FIG. 1.
Figure 3:
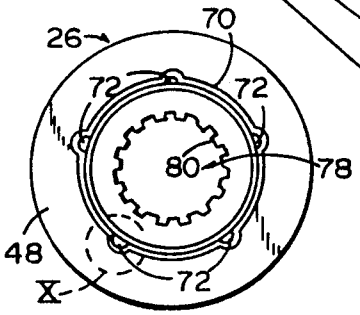
FIG. 3 is a rear end elevational view of the shaft sleeve of FIG. 2.

Similar to hub assembly 22, shaft sleeve 26 may be made of any of the known materials for marine propellers, including, but not limited to, aluminum, bronze, and stainless steel for example. Shaft sleeve 26 is preferably a single piece molding of a fiber reinforced plastic material such as a 40% glass filled thermoplastic for example, as discussed above. Shaft sleeve 26 is a generally cylindrical member, corresponding to aperture 66, with an outer wall 70 and a series of equally spaced teeth 72 disposed circumferentially thereabout (FIGS. 1-3). Shaft sleeve 26 is sized for hand forced slip fit engagement in an axial direction with aperture 66.

Figure 10:
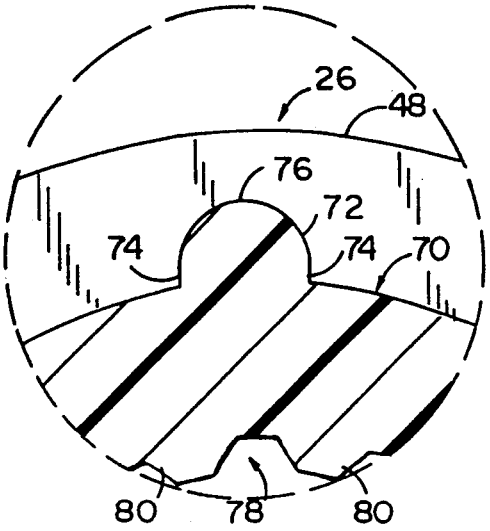
FIG. 10 is an enlarged cross-sectional view of detail X of FIG. 3.

Teeth 72 extend linearly along the length of shaft sleeve 26 from a circumscribing flange portion 48 at its forward end to a point near, but spaced away from, the rear end of shaft sleeve 26, leaving a cylindrical portion 54 of shaft sleeve 26 which corresponds to aperture 50. However, depending upon the specific installation, teeth 72 may also extend curvilinearly along the length of shaft sleeve 26, defining a helical pattern (not shown). Each tooth 72 has a generally oval cross-sectional shape, specifically a U-shaped cross section with a pair of generally planar side walls 74 extending to and terminating at outer wall 70 from a semi-circular bight portion 76 (FIG. 10).

Shaft sleeve 26 also has a generally cylindrical mounting aperture 78 extending coaxially through sleeve 26. Mounting aperture 78 is adapted for slip fit engagement with a propeller drive shaft. Mounting aperture 78 may be formed with a series of splines 80 for mounting on a correspondingly splined propeller shaft. Alternatively, mounting aperture 78 may take on configurations other than that shown in the figures as is appropriate for connection of propeller 20 with a specific propeller shaft.

In use, propeller 20 is easily assembled by sliding shaft sleeve 26 into aperture 66 of insert 24, using hand force, and inserting the combination of shaft sleeve 26 and insert 24 into cavity 38 of hub assembly 22. Alternatively, hub assembly 22 and insert 24 may be combined and shaft sleeve 26 then inserted into aperture 66 of insert 24, using hand force. In their assembled positions, shaft sleeve cylindrical portion 48 nestles into hub cylindrical recess 46 and shaft sleeve rear portion 54 nestles into hub cylindrical aperture 50. This arrangement offers a benefit of isolating insert 24 from the hostile environment in which a marine propeller is used. Specifically, exposure of insert 24 to exhaust fluids passing through hub assembly 22 is minimized. Assembled propeller 20 is easily mounted on a propeller shaft by any of the various methods commonly known.

Figure 9:
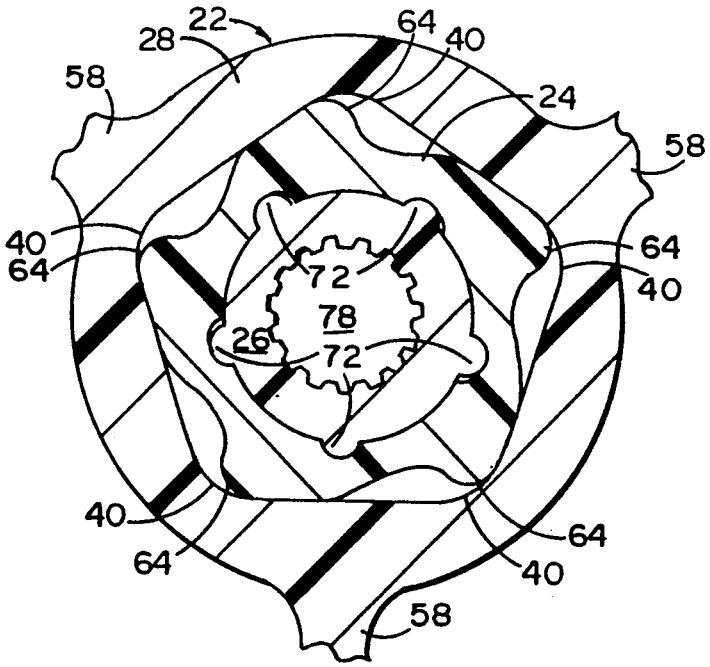
FIG. 9 is the view of FIG. 8 under a high torque load condition showing distortion of the insert.

If propeller 20 is subjected to a severe torque load during use, such as striking an underwater obstacle, insert 24 will deform from its normal or molded pentagonal shape and allow relative rotational slippage between hub assembly 22 and shaft sleeve 26 (FIG. 9). Specifically, insert 24 will compress and flow into a space defined between adjoining pairs of teeth 72 and hub inner wall 36 while shaft sleeve 26 rotates relative to hub assembly 22 (FIG. 9). While some relative rotation between shaft sleeve 26 and insert 24 may also occur, this rotation is minor, if not insignificant.

After propeller 20 is subjected to a severe torque load as described above, propeller 20 retains its design torque load capacity even in the displaced condition described and shown in FIG. 9. Thus, propeller 20 provides significant residual torque load capacity after a severe torque incident so that the vessel is not stranded and may proceed normally. Further, the design torque load is maintained so that occurrence of a subsequent severe torque incident will not result in propulsion system damage by transferring excessive torque loading.

As with any marine propulsion system component, propeller 20 should also be inspected for damage after impacting an underwater obstacle or other severe torque load incident. Propeller 20 is easily disassembled using standard shop tools to remove shaft sleeve 26 and insert 24 from cavity 38 and to remove insert 24 from shaft sleeve 26 (FIG. 1). After inspection and verification that hub assembly 22, insert 24, and shaft sleeve 26 are undamaged, propeller 20 may be easily reassembled and remounted as described above. The use of appropriate materials, whether metals or fiber reinforced plastics as discussed above, for hub assembly 22 and shaft sleeve 26 enhances the damage-free use of propeller 20. Further as discussed above and further below, use of appropriate resilient, natural or synthetic materials for insert 24 also enhances the damage free use of propeller 20.

The slippage behavior or propeller 20 is in part attributable to the durometer specification of insert 24 and in part to the geometry of the interfaces between shaft sleeve 26 and insert 24 and between insert 24 and hub assembly 22. Insert materials possessing lower durometer specifications than the preferred range of 90-95 result in excessive slippage between shaft sleeve 26 and insert 24 so that maximum or design torque loading and transfer from the propeller shaft to blades 32 cannot reliably be obtained.

Figure 11:
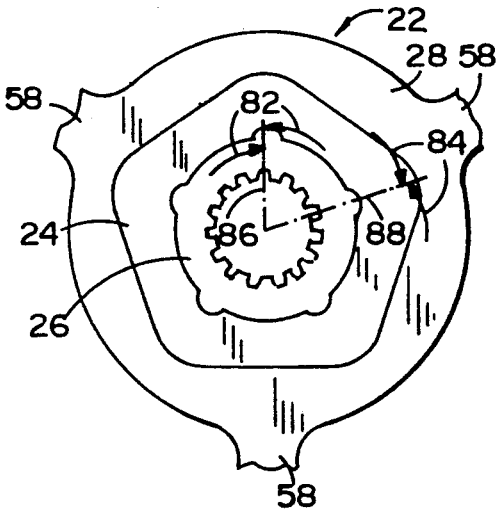
FIG. 11 is a schematic diagram of forces, shown on the view of FIG. 8.

With too low of a durometer specification for insert 24, the insert does not slip significantly relative to hub assembly 22 and shaft sleeve 26 slips excessively relative to insert 24. This phenomenon results in part because the rotational shear forces 82 acting at the interface between shaft sleeve 26 and insert 24 are greater than the rotational shear forces 84 acting at the interface between insert 24 and hub assembly 22 for a given torque load on propeller 20, between blades 32 and the propeller shaft (FIG. 11). This relationship of shear forces at these two interfaces occurs because the relative moment arm 86 from the center of the propeller shaft to sleeve outer wall 70 is shorter than the moment arm 88 between the center of the propeller shaft to insert outer surface 62 (FIG. 11). Thus, reliable design torque loading is more readily obtained with the use of an insert material having an appropriate durometer specification in combination with a shaft sleeve 26 to insert 24 interface having an appropriate configuration to avoid rotational slippage between shaft sleeve 26 and insert 24 and thereby restrict rotational slippage to the interface between insert 24 and hub assembly 22.

The generally oval, specifically U-shaped, cross section of teeth 72 transfers relatively high rotational forces from shaft sleeve 26 to insert 24 without a tendency for insert 24 to ramp over or lift away from shaft sleeve 26 and ride over the tops of teeth 72 (FIG. 10). Further, the preferred shape of teeth 72 avoids high stress concentrations in the vicinity of insert aperture 66. This characteristic of avoiding high stress concentrations minimizes any potential localized damage to insert 24 and any need to replace insert 24 because of such damage after severe torque loading of propeller 20.

Figure 12:
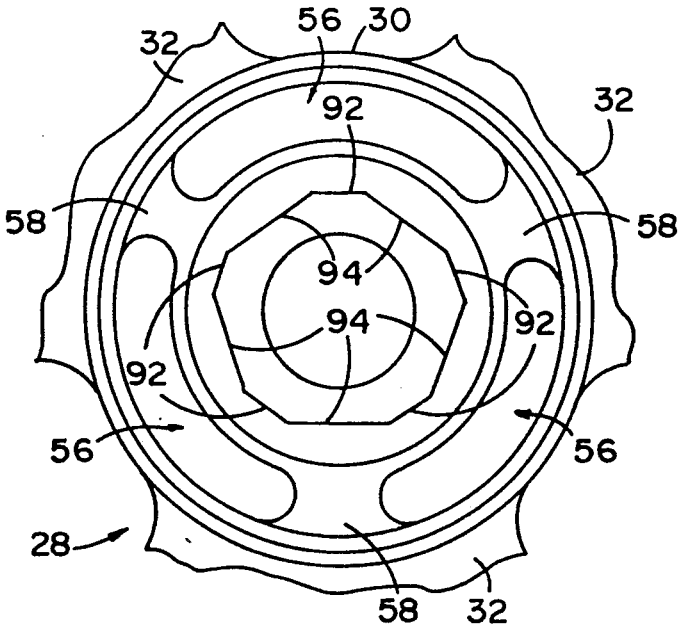
FIG. 12 is the view of FIG. 6 showing an example of a modified cross-sectional shape for the insert and insert aperture.

The above description is considered that of the preferred embodiment only. Modifications of the invention, such as use of hub assembly 22 and insert 24 with a propeller shaft corresponding to the outer configuration of shaft sleeve 26 whereby the present invention may be practiced without the use of shaft sleeve 26 for example, will occur to those who make or use the invention. Another example of a modification which may occur to those who make or use the invention and which is included in the scope of the invention is the use of a decagonal cross-sectional shape for cavity 38 wherein a first set of five equal length sides 92 are interposed between a second set of five equal length sides 94, thereby approximating the preferred pentagonal cross-sectional shape with rounded vertices 40 (FIGS. 6 and 12). Therefore, it is understood that the embodiment shown in the drawings and described above is merely for illustrative purposes and is not intended to limit the scope of the invention, which is defined by the following claims as interpreted according to the principles of patent law.

The embodiments of the invention in which an exclusive property or privilege is claimed are defined as follows:

1. A propeller comprising:

a hub having a longitudinal axis and a first aperture with a generally polygonal cross-sectional shape extending coaxially through at least a portion of said hub; and an insert corresponding to and positioned in said first aperture, said insert comprising a resilient material, said insert compressing and deforming when a predetermined amount of torque is applied to said propeller whereby the entire insert moves in a rotational direction about said longitudinal axis, separate and apart from said hub, and relative to said hub when said torque is applied.

2. The propeller defined in claim 1 wherein said first aperture has a generally pentagonal cross-sectional shape.

3. The propeller defined in claim 1 wherein said first aperture and said insert are adapted for sliding engagement in an axial direction with each other so that said insert may be inserted into and removed from said first aperture.

4. The propeller defined in claim 1 wherein said insert has a second aperture extending coaxially through at least a portion of said insert and said insert includes means for connection between said second aperture and a propeller shaft for driving said propeller.

5. The propeller defined in claim 4 wherein said second aperture is generally cylindrical with a series of grooves spaced circumferentially thereabout.

6. The propeller defined in claim 1 further including a shaft sleeve interposed between said insert and a propeller shaft for driving said propeller, said sleeve having a mounting aperture extending coaxially through at least a portion of said sleeve and said mounting aperture being adapted for connection with the propeller shaft.

7. The propeller defined in claim 6 wherein said insert has a second aperture corresponding to said sleeve and extending coaxially through at least a portion of said insert, for receiving said sleeve.

8. The propeller defined in claim 7 wherein said sleeve has length and a generally cylindrical outer wall with a series of teeth spaced circumferentially thereabout, said teeth extending along at least a portion of said length.

9. The propeller defined in claim 8 wherein said teeth have a generally oval cross section.

10. The propeller defined in claim 9 wherein said teeth have a U-shaped cross section with a pair of generally planar side walls extending in the same general direction to said outer wall, from opposite ends of a semicircular bight portion.

11. The propeller defined in claim 8 wherein said teeth extend linearly along said sleeve.

12. A marine propeller comprising:

a hub having a longitudinal axis and a generally pentagonal aperture extending coaxially through at least a portion of said hub;

an annular insert corresponding to and substantially filling said pentagonal aperture, said insert and said pentagonal aperture being adapted for sliding engagement in an axial direction with each other, said insert comprising a resilient material so that said insert compresses, deforms, and rotates relative to said hub when a predetermined amount of torque is applied to said propeller, said insert having a second aperture extending coaxially through at least a portion of said insert; and an annular shaft sleeve corresponding to and substantially filling said second aperture, said sleeve having a mounting aperture extending coaxially through at least a portion of said sleeve, said mounting aperture being adapted for engagement with a propeller shaft for driving said propeller.

13. The propeller defined in claim 12 wherein each vertex of said pentagonal aperture is rounded.

14. The propeller defined in claim 12 wherein said sleeve has length and a generally cylindrical outer wall with a series of teeth spaced circumferentially thereabout, said teeth extending along at least a portion of said length.

15. The propeller defined in claim 14 wherein said teeth have a generally oval cross section.

16. The propeller defined in claim 15 wherein said teeth have a U-shaped cross section with a pair of generally planar side walls extending in the same general direction to said outer wall, from opposite ends of a semicircular bight portion.

17. The propeller defined in claim 14 wherein said teeth extend linearly along said sleeve.

18. A torque transfer coupling for use in a marine propeller having a hub and a longitudinal axis about which the propeller rotates, comprising:

first means for defining an elongated cavity in the hub, said cavity having a length extending coaxially through at least a portion of the hub and having a generally polygonal cross-sectional shape; and an insert positioned in said cavity, said insert corresponding to said cavity and comprising a resilient material, said insert compressing and deforming when a predetermined amount of torque is applied to said coupling whereby the entire insert moves in a rotational direction about said longitudinal axis, separate and apart from said hub, and relative to said hub when said torque is applied.

19. The coupling defined in claim 18 wherein the hub has a forward face and said cavity penetrates the hub forward face for access to said cavity.

20. The coupling defined in claim 19 wherein said insert and said cavity are adapted for sliding engagement in an axial direction with each other so that said insert may be inserted into and removed from said cavity.

21. The coupling defined in claim 19 wherein said cavity has a generally pentagonal cross-sectional shape.

22. The coupling defined in claim 18 wherein said insert has a first aperture extending coaxially through at least a portion of said insert and includes means for connection between said first aperture and a propeller shaft for driving said propeller.

23. The coupling defined in claim 22 wherein said first aperture is generally cylindrical with a series of grooves spaced circumferentially thereabout.

24. The coupling defined in claim 18 further including a shaft sleeve interposed between said insert and a propeller shaft for driving a propeller, said sleeve having a mounting aperture extending coaxially through at least a portion of said sleeve and said mounting aperture being adapted for connection with the propeller shaft.

25. The coupling defined in claim 24 wherein said insert has a first aperture corresponding to said sleeve and extending coaxially through at least a portion of said insert, for receiving said sleeve.

26. The propeller defined in claim 24 wherein said sleeve has length and a generally cylindrical outer wall with a series of teeth spaced circumferentially thereabout, said teeth extending along at least a portion of said length.

27. The coupling defined in claim 26 wherein said teeth have a generally oval cross section.

28. The coupling defined in claim 27 wherein said teeth have a U-shaped cross section with a pair of generally planar side walls extending in the same general direction to said outer wall, from opposite ends of a semicircular bight portion.

29. The coupling defined in claim 26 wherein said teeth extend linearly along said sleeve.

* * * * *